US005442151A

United States Patent [19]

Strang et al.

[11] Patent Number: 5,442,151

[45] Date of Patent: Aug. 15, 1995

[54] BUTTON WELL COMPRESSION SEAL ASSEMBLY

[75] Inventors: Ward E. Strang, Fairfield; Carol Z. Howard, Oxford, both of Conn.

[73] Assignee: Hubbell Incorporated, Orange, Conn.

[21] Appl. No.: 229,855

[22] Filed: Apr. 19, 1994

Related U.S. Application Data

[63] Continuation of Ser. No. 27,888, Mar. 8, 1993, abandoned.

[51] Int. Cl.[6] ..... H01H 13/06

[52] U.S. Cl. ..... 200/302.2

[58] Field of Search ..... 200/302.2, 512

[56] References Cited

U.S. PATENT DOCUMENTS

| | | | |
|---|---|---|---|
| 4,170,104 | 10/1979 | Yamagata | 200/302.2 |
| 4,540,865 | 9/1985 | Calder | 200/512 |
| 4,641,004 | 2/1987 | Keprda | 200/302.2 |
| 4,673,780 | 6/1987 | Kenway | 200/302.2 |
| 4,766,271 | 8/1988 | Mitsuhashi et al. | 200/512 |
| 5,172,805 | 12/1992 | Gumb | 200/302.2 |

*Primary Examiner*—Renee S. Luebke

*Attorney, Agent, or Firm*—Jerry M. Presson; Michael R. Swartz

[57] ABSTRACT

A compression seal assembly includes an elongated annular wall defining a passageway in a housing of a device, a push button disposed in the passageway, and an annular flange flexibly attached to the push button and compressed by the annular wall against a stationary wall to define a hermetic seal surrounding the push button. The annular wall has an outer end connected to an annular portion on the housing which defines an opening which is axially aligned with the passageway of the annular wall. The annular wall has an inner end which is spaced through a predetermined distance from a surface in the interior cavity of the housing. The push button has a body portion extending through the passageway of the annular wall and being movable relative thereto. The body portion of the push button has an upper end disposed adjacent to the housing opening and a lower end disposed adjacent to and spaced from the surface in the interior cavity of the housing. The annular flange is disposed about and adjacent to the lower end of the body portion of the push button and upon the surface in the interior cavity of the housing. The flange is compressed between the inner end of the annular wall and the surface in the interior cavity of the housing sufficiently to define a hermetic seal therebetween.

6 Claims, 4 Drawing Sheets

BUTTON WELL COMPRESSION SEAL ASSEMBLY

This is a continuation of application Ser. No. 08/027,888 filed on Mar. 8, 1993 and now abandoned. doned.

BACKGROUND OF THE INVENTION

1. Field of the Invention

The present invention generally relates to a ground fault circuit interrupter (GFCI) unit and, more particularly, is concerned with a button well compression seal assembly employed in the GFCI unit.

2. Description of the Prior Art

As is well-known, a GFCI unit is a device for protecting an electrical circuit from the hazards of ground fault currents, as distinguished from other types of faults such as short circuits and other overcurrent abnormalities. A ground fault is one which occurs, in a circuit having a neutral conductor grounded at its source, when contact is made with an electrified conductor in the circuit through a person or a conductive article in contact with the ground. This results in a ground fault current flowing back to the grounded source partially or wholly through a ground path.

One GFCI unit commercially-available from Harvey Hubbell Incorporated of Bridgeport, Connecticut, USA, includes a housing enclosing an arrangement of electronic and electro-mechanical components which interconnect corresponding live, neutral and ground conductors of a pair of three-wire electrical power cords. The conductors of one of the power cords are terminated by a male plug, while the conductors of the other power cord are terminated by a female plug. The electro-mechanical components of the GFCI unit include test and reset buttons which are accessible through openings defined in the front side of the housing.

The housing of the GFCI unit must be hermetically sealed to keep out moisture which would disrupt the proper functioning of the electronic and electro-mechanical components contained therein. The housing is comprised of a front cover and rear base which at their rims are adhesively sealed to one another about most of their peripheries and to strain relief connectors on the power cords at their opposite ends. However, a potential source of moisture infiltration exists through the openings in the front cover which provide access to the test and rest buttons.

Consequently, a need exists for some means to provide hermetic seals between the housing openings and the test and reset buttons which will prevent moisture from entering the housing but at the same time not interfere with the proper functioning of the test and reset buttons.

SUMMARY OF THE INVENTION

The present invention provides a button well compression seal assembly designed to satisfy the aforementioned needs. The compression seal assembly of the present invention meets the requirements of providing an effective hermetic seal between the housing and respective one button without impeding the proper functioning of the button.

Accordingly, the present invention is directed to a compression seal assembly which comprises: (a) a stationary elongated annular wall having a passageway extending therethrough; (b) a push button disposed in the passageway; and (c) an annular flange flexibly attached to the push button and supported upon a stationary surface so as to mount the push button for undergoing reciprocal movement through the passageway relative to the stationary annular wall, the annular flange being fabricated of flexible compressible material and being contacted and compressed by the annular wall against the surface to define a hermetic seal surrounding the push button. The annular wall has an outer end which defines an opening which is axially aligned with the passageway of the annular wall and through which an outer end of the push button can be touched. The annular wall has an inner end which is spaced a predetermined distance from the stationary surface. The push button has a body portion extending through the passageway of the annular wall and being movable relative thereto and relative to the surface. The body portion of the push button has an upper end disposed adjacent to the opening and a lower end disposed adjacent to and spaced from the surface. The annular flange is disposed about and adjacent to the lower end of the body portion of the push button and upon the surface. In an alternative embodiment, the annular flange includes an upstanding peripheral rim integral with the annular flange that surrounds the annular wall. The assembly also includes an annular resiliently flexible web movably connecting the annular flange to the lower end of the body portion of the push button so as to accommodate reciprocal movement of the body portion toward and away from the surface. The thickness of the annular flange is greater than the predetermined distance between the inner end of the annular wall and the surface such that the annular flange is compressed between the inner end of the annular wall and the surface sufficiently to defined a hermetic seal therebetween. In the alternative embodiment, the integral peripheral rim contacts the outer surface of the annular wall so as to facilitate proper alignment of the body portion of the push button within the passageway defined by the annular wall.

The present invention is also directed to the above-defined compression seal assembly incorporated in a device which includes a housing formed by a plurality of parts assembled together and having an interior cavity defined by the assembled parts. One of the parts of the housing has an annular portion defining the opening communicating from outside of the housing into the interior cavity thereof. The device also includes means defining the surface in the interior cavity of the housing being spaced from the opening in the one housing part upon which the flange of the compression seal assembly is seated.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
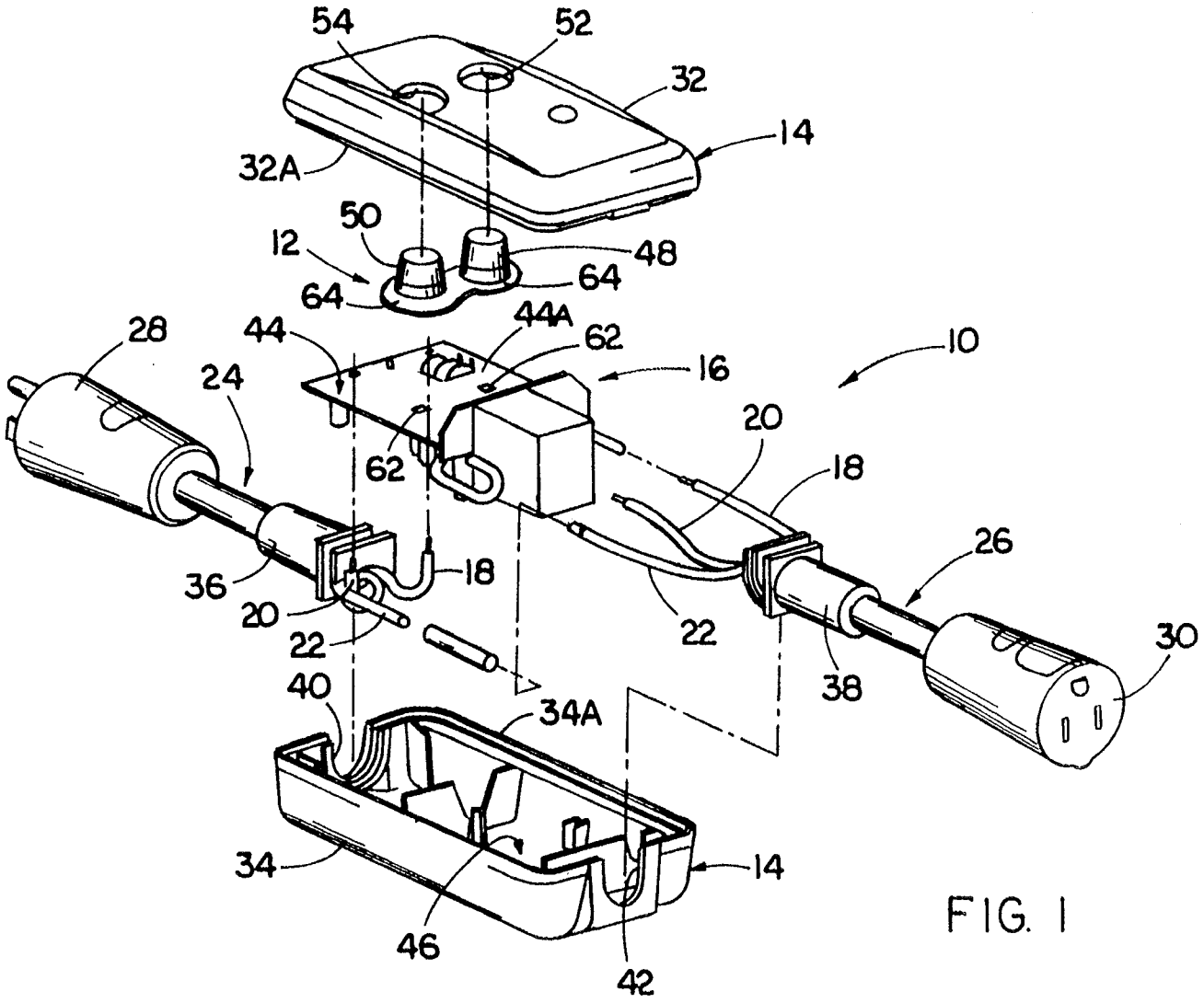
FIG. 1 is an exploded perspective view of a GFCI unit incorporating a pair of button well compression seal assemblies of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 2:
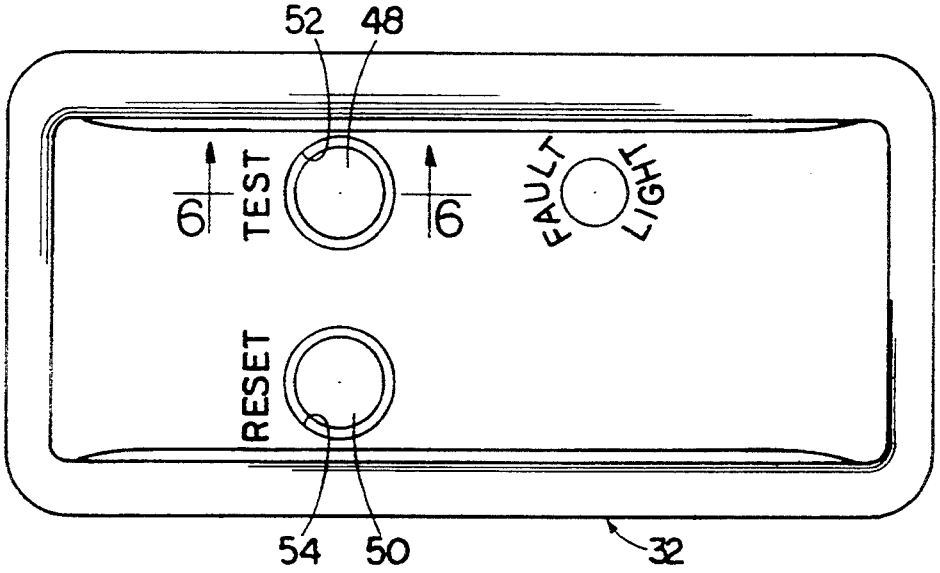
FIG. 2 is an enlarged top plan view of the GFCI unit of FIG. 1.

Referring now to the drawings, and particularly to FIGS. 1 and 2, there is illustrated a ground fault circuit interrupter (GFCI) unit, generally designated 10, which incorporates a pair of button well compression seal assemblies, generally designated 12, in accordance with the present invention. While each of the button well compression seal assemblies 12 of the present invention is shown associated with a GFCI unit 10, it should be readily apparent that use of the compression seal assembly 12 is not so limited; the compression seal assembly 12 is applicable to many other kinds of devices employing push buttons exposed at the exterior of the housing of the unit where it is desired to prevent infiltration of moisture past the button and into the housing.

The GFCI unit 10 generally includes a housing 14 enclosing an arrangement of electronic and electromechanical components, generally designated 16, which interconnect corresponding live, neutral and ground conductors 18, 20, 22 of a pair of three-wire electrical power cords 24, 26. The conductors 18, 20, 22 of one of the power cords 24 are terminated by a male plug 28, while the conductors 18, 20, 22 of the other power cord 26 are terminated by a female plug 30. The housing 14 is formed by a front cover 32 and rear base 34 which at their respective rims 32A, 34A are adhesively sealed to one another and to strain relief connectors 36, 38 provided on the respective power cords 24, 26 which also interfit within slots 40, 42 defined in the opposite ends of the rear base 34. The electronic components (not shown) of the arrangement 16 are mounted on a printed circuit board 44 which is supported within an interior cavity 46 defined between the front cover 32 and rear base 34 of the housing 14. The electromechanical components of the arrangement 16 within the GFCI unit include test and reset keypad push buttons 48, 50 which are accessible through openings 52, 54 defined in the front cover 32 of the housing 14.

The adhesive applied on the rims 32A, 34A of the front cover 32 and rear base 34 of the housing 14 hermetically seals the housing 14 at these regions thereof so as to keep out moisture which would disrupt the proper functioning of the electronic and electro-mechanical components contained therein. However, a potential route for moisture infiltration into the housing 14 also exists through the openings 52, 54 in the front cover 32 which provide access to the test and rest push buttons 48, 50. The button well compression seal assemblies 12 of the present invention are provided to block moisture penetration through these regions of the housing 14.

Figure 3:
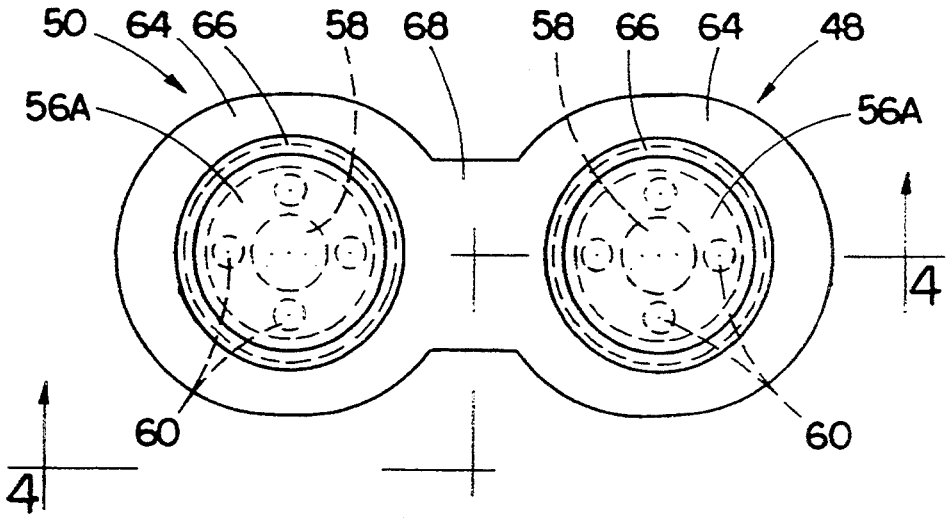
FIG. 3 is a top plan view of test and reset buttons removed from the housing of the GFCI unit and as seen along line 3—3 of FIG. 4.
Figure 4:
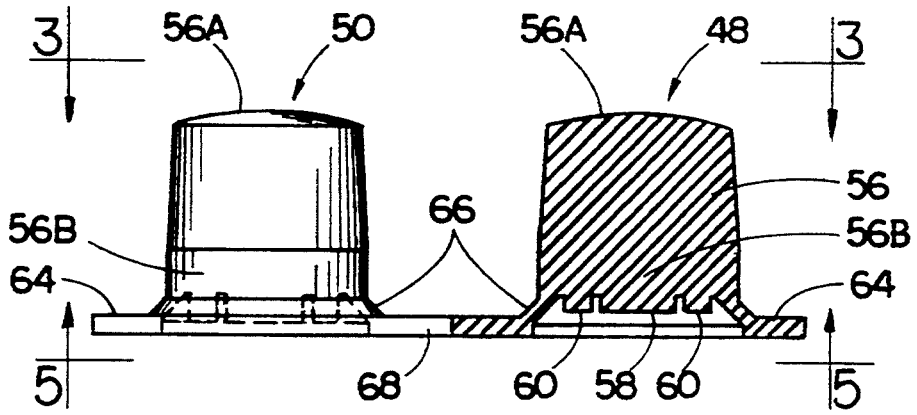
FIG. 4 is a side elevational view of the test and reset buttons as seen along line 4—4 of FIG. 3.
Figure 5:
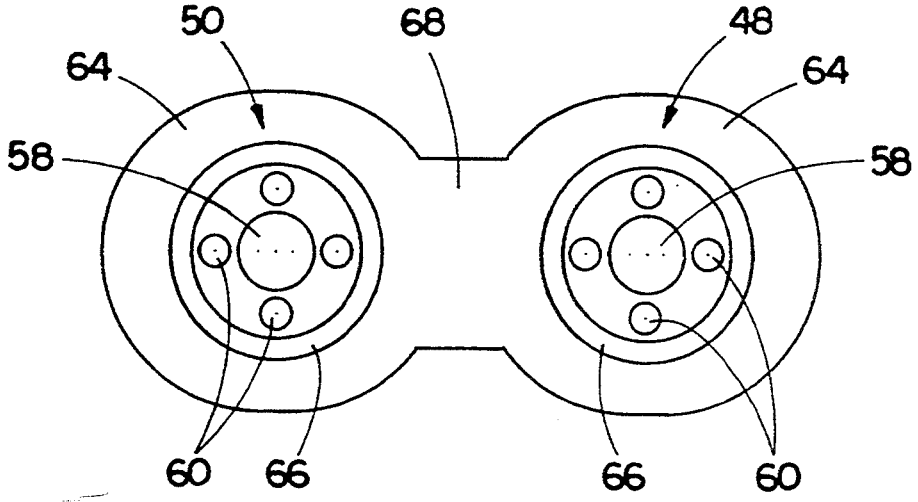
FIG. 5 is a bottom plan view of the test and reset buttons as seen along line 5—5 of FIG. 4.
Figure 10:
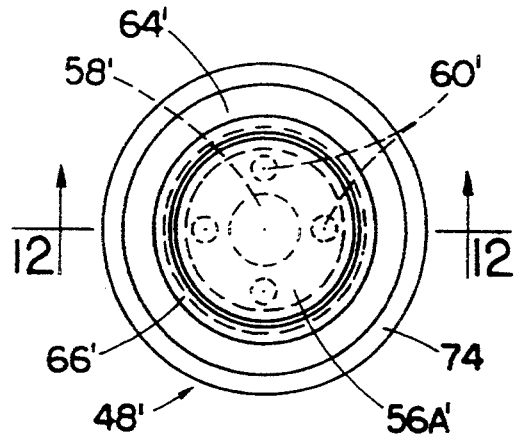
FIG. 10 is a top plan view of the alternative button as seen along line 10—10 of FIG. 9.
Figure 9:
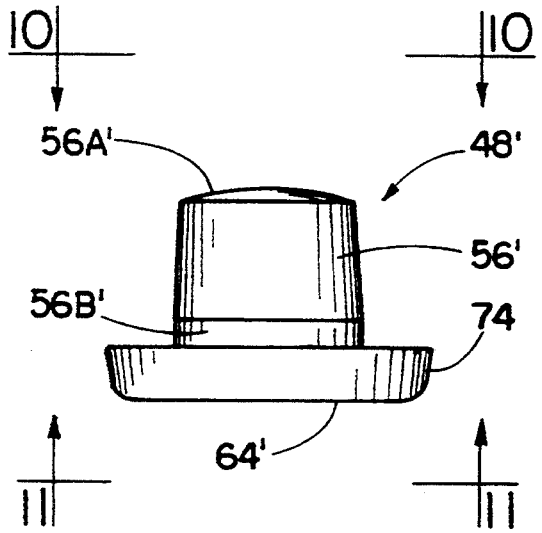
FIG. 9 is a side elevational view of an alternative embodiment of the push button.
Figure 12:
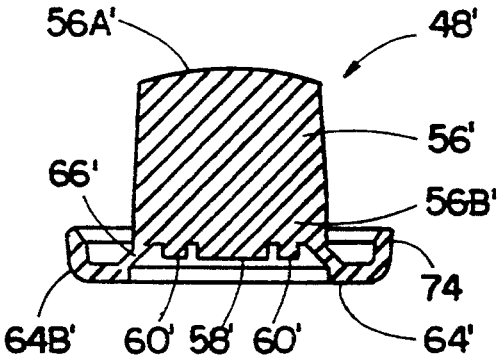
FIG. 12 is a sectional view of the alternative button as seen along line 12—12 of FIG. 10.
Figure 11:
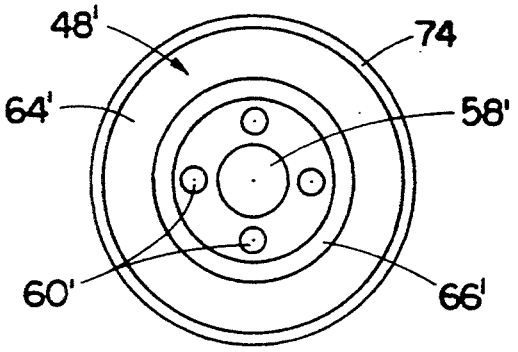
FIG. 11 is a bottom plan view of the alternative button as seen along line 11—11 of FIG. 9.

Referring to FIGS. 3-5, there is illustrated the test and reset keypad push buttons 48, 50 employed by the GFCI unit 10 and by the compression seal assemblies 12 of the present invention. Each of the push buttons 48, 50 includes a solid body portion 56 made of a suitable material such as rubber. On the bottom of the body portion 56 is a centrally-located electrical contact pad 58 and a plurality of non-electrical support pads 60 disposed about the central contact pad 58 in a circumferentially spaced arrangement relation to one another. The support pads 60 ensure a balanced or uniform electrical contact between the central electrical contact pad 60 and electrical contact traces 62 on the printed circuit board 44 (see FIG. 1).

Also, an annular flange 64 is supported upon a stationary surface 44A (FIG. 1) provided by the printed circuit board 44 about an inner end of the body portion 56 of each push button 48, 50. Further, an annular web 66 is provided which is integrally connected between the annular flange 64 and the solid body portion 56 of each button 48, 50 and movably connects and mounts the button for reciprocal movement relative to the printed circuit board 44. The annular flange 64 and annular web 66 are fabricated of a suitable flexible compressible material, such as rubber. The annular web 66 extends at an upwardly and inwardly inclined angle, such as 45°, relative to the annular flange 64. While the buttons 48, 50 and their associated flanges 64 can be entirely separate, preferably for easier installation the annular flanges 64 are interconnected at adjacent sides by another web portion 68 to one another such that the buttons 48, 50 are coupled together at the flanges.

Figure 8:
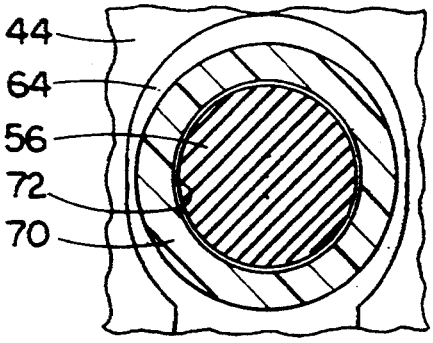
FIG. 8 is an enlarged sectional view of the button and well structure taken along line 8—8 of FIG. 6.
Figure 7:
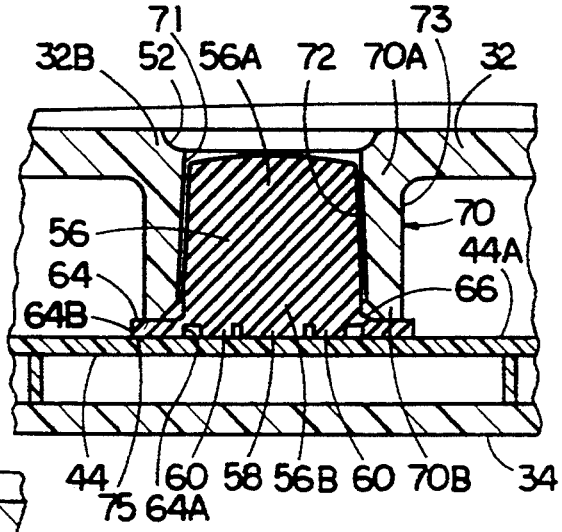
FIG. 7 is another view similar to that of FIG. 6, except showing the test button in a depressed actuated position.
Figure 6:
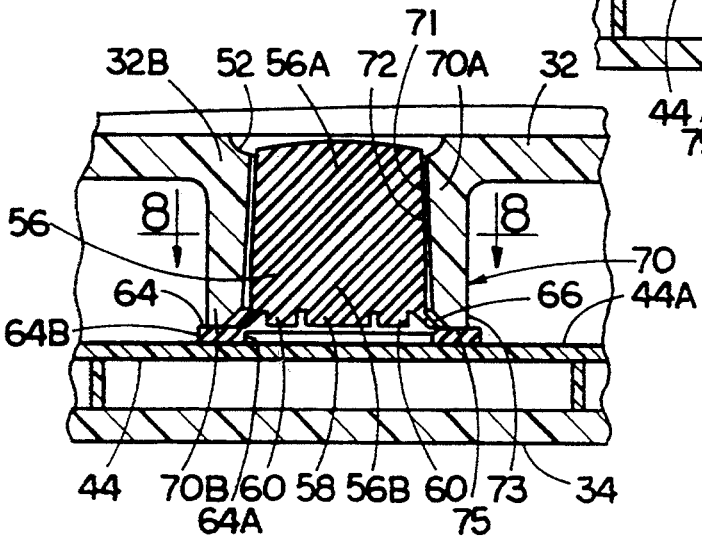
FIG. 6 is an enlarged sectional view of the button well compression seal assembly of the present invention taken along line 6—6 of FIG. 2, showing a test button in a raised non-actuated position.

Referring to FIGS. 6-8, there is illustrated one of the compression seal assemblies 12 of the present invention. Since each of the compression seal assemblies 12 is identical to the other, only one need be described in detail hereinafter.

Each compression seal assembly 12 includes one of the push buttons 48, 50, annular flanges 64 and annular webs 66 as described above and, in addition thereto, includes a well structure in the form of an elongated annular wall 70. The annular wall 70 has an annular interior surface 71 defining an internal passageway 72 axially aligned with the respective opening 52, 54, an annular exterior surface 73 spaced outwardly from and surrounding the annular interior surface 71 and a pair of opposite outer and inner ends 70A, 70B at opposite ends of the annular interior and exterior surfaces 71, 73. The outer end 70A of the annular wall 70 is integrally connected to an annular portion 32B on the front cover 32 of the housing 14 which defines the respective opening 52, 54 therethrough. The inner end 70B of the annular wall 70 is provided with an edge surface 75 extending between the interior and exterior surfaces 71, 73 of the annular wall 70 and is spaced through a predetermined distance from the stationary support surface 44A on the printed circuit board 44 in the interior cavity 46 of the housing 14.

The body portion 56 of the respective push button 48, 50 extends through the passageway 72 of the annular wall 70 and is movable relative thereto. The inside diameter of the annular wall 70 defining the passageway 72 is slightly larger than the outside diameter of the respective push button 48, 50. An upper end 56A of the body portion 56 of the respective push button 48, 50 is disposed adjacent to the respective housing opening 52, 54 where the button can be touched by a user. A lower end 56B of the body portion 56 of the respective push button 48, 50 is disposed adjacent to and spaced from the stationary surface 44A of the printed circuit board 44 in the interior cavity 46 of the housing 14. The respective annular flange 64 is disposed about and adjacent to the lower end 56B of the respective push button 48, 50 and rests upon the stationary surface 44A of the printed circuit board 44 in the interior cavity 46 of the housing 14. The annular flange 64 also extends between the edge surface 75 of the inner end 70B of the annular wall 70 and the stationary surface 44A from an inner peripheral portion 64A of the annular flange 64 being disposed adjacent to the interior surface 71 of the annular wall 70 to an outer peripheral portion 64B of the annular flange 64 disposed slightly beyond the exterior surface 73 of the annular wall 70, as seen in FIGS. 6 and 7. The thickness of the annular flange 64 is greater than the predetermined distance between the inner end 70B of the annular wall 70 and the stationary support surface 44A of the printed circuit board 44 such that the annular flange 64 is compressed between the inner end 70B of the annular wall 70 and the printed circuit board surface 44 sufficiently to defined a hermetic seal therebetween. The resiliently flexible material and configuration of the annular web 66, which movably connects the annular flange 64 to the lower end 56B of the body portion 56 of the respective push button 48, 50, biases the push button to the raised non-actuated position of FIG. 6, but also accommodates reciprocal movement of the body portion 56 toward and away from the depressed actuated position of FIG. 7 wherein the contact pad 58 is brought into electrical contact with the respective electrical contract trace 62 on the stationary surface 44A of the printed circuit board 44.

FIGS. 9–12 show an alternative embodiment for each of the push buttons 48, 50; the alternative button being referred to by the numeral 48' and the components thereof have been identified with the same reference numerals as the previously described test button 48 except for the addition of a prime mark (′). The construction of the alternative button 48' is substantially identical to that of test button 48 except for the addition of an upstanding peripheral rim 74 integrally formed on the outer peripheral portion 64B′ of annular flange 64'. The upstanding peripheral rim 74 is designed to surround and contact the exterior surface at the inner end of the annular wall 70 in thereby defining a male-female socket connection of the lower end portion of the annular wall 70 and the lower end portion of the body portion 56', annular flange 64' and peripheral rim 74 so as to facilitate proper alignment of the body portion 56' within the passageway 72 of the annular wall 70.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a device including a housing having an interior cavity, an outer cover enclosing a portion of said interior cavity, said outer cover having an exterior surface and an annular portion defining an opening through said outer cover from said exterior surface thereof into said interior cavity, and a stationary surface disposed in said interior cavity and spaced from said annular portion of said outer cover, a compression seal assembly disposed in said interior cavity of said housing between said stationary surface and said exterior surface of said outer cover, said compression seal assembly comprising:

(a) a stationary elongated annular wall disposed in said interior cavity in alignment with said opening, said annular wall having an outer end attached to said annular portion of said outer cover, said annular wall extending therefrom in said interior cavity toward said stationary surface therein, said annular wall also having an inner end spaced from said stationary surface, said annular wall further having an annular interior surface extending between said outer and inner ends thereof and defining an interior passageway extending from said opening in said outer cover toward said stationary surface, said annular wall still further having an annular exterior surface spaced outwardly from and surrounding said annular interior surface;

(b) a push button having a body portion extending through said passageway of said annular wall and disposed above said stationary surface and below said exterior surface of said outer cover, said body portion of said push button having a lower end disposed above said stationary surface and an upper end disposed below said exterior surface of said outer cover and exposed through said opening of said outer cover where said push button can be touched by a user;

(c) an annular flange flexibly attached to said lower end of said body portion of said push button and supported above and upon said stationary surface so as to mount said push button for reciprocal movement through and within said passageway relative to said stationary annular wall and toward and away from said stationary surface located below said push button, said annular flange being fabricated of flexible compressible material and being contacted and compressed by said inner end of said annular wall against said stationary surface to define a hermetic seal surrounding said lower end of said body portion of said push button;

(d) said inner end of said annular wall having an an edge surface extending between said interior and exterior surfaces of said annular wall and being spaced a predetermined distance above said stationary surface;

(e) said annular flange being disposed upon said stationary surface and extending between said edge surface of said inner end of said annular wall and said stationary surface from an inner peripheral portion of said annular flange disposed adjacent to said interior surface of said annular wall to an outer peripheral portion of said annular flange disposed slightly beyond said exterior surface of said annular wall; and (f) an upstanding peripheral rim attached on said outer peripheral portion of said annular flange and projecting upwardly therefrom and surrounding said exterior surface of said annular wall, said peripheral rim terminating closer to said inner end than to said outer end of said annular wall so as to define a socket extending about said inner end and spaced below said outer end of said annular wall facilitating proper alignment of said body portion of said push button within said passageway defined by said annular wall.

2. The assembly as recited in claim 1, wherein the thickness of said annular flange is greater than the predetermined distance between said inner end of said annular wall and the stationary surface such that said annular flange is compressed between said inner end of said annular wall and the stationary surface sufficiently to define said hermetic seal therebetween.

3. The assembly as recited in claim 1, further comprising:

an annular resiliently flexible web movably connecting said annular flange to said lower end of said body portion of said push button so as to accommodate reciprocal movement of said body portion toward and away from the stationary surface.

4. The assembly as recited in claim 3, wherein said annular web extends at an upwardly and inwardly inclined angle relative to said annular flange.

5. In a device including a housing formed by a plurality of parts assembled together and having an interior cavity defined by said assembled parts, one of said parts having an exterior surface and an annular portion defining an opening through said exterior surface communicating from outside of said housing into said interior cavity thereof, said device also including means defining a stationary surface in said interior cavity of said housing being spaced from said opening in said one housing part, a compression seal assembly, comprising:

(a) an elongated annular wall disposed in said interior cavity of said housing and below said exterior surface of said one housing part, said annular wall having an annular interior surface defining a passageway extending therethrough, an annular exterior surface spaced outwardly from and surrounding said annular inner surface, and spaced apart opposite outer and inner ends disposed at opposite ends of said annular interior and exterior surfaces, said outer end of said annular wall being connected to said annular portion of said one housing part defining said opening such that said passageway of said annular wall is aligned axially with said opening in said housing part, said annular wall extending in said interior cavity of said housing from said outer end of said annular wall to said inner end of said annular wall spaced a predetermined distance from said stationary surface defining means in said interior cavity of said housing;

(b) a push button having a body portion extending through said passageway defined by said annular wall between said outer and inner ends thereof, said push button being movable relative to said annular wall and having an upper end disposed below said exterior surface on and adjacent to said opening in said one housing part and a lower end disposed adjacent to and spaced from said stationary surface defining means in said interior cavity of said housing;

(c) an annular flange disposed about and adjacent to said lower end of said body portion of said push button and upon said surface defining means in said interior cavity of said housing, said annular flange being fabricated of a flexible compressible material;

(d) an annular web connecting said annular flange to said lower end of said body portion of said push button so as to accommodate reciprocal movement of said body portion of said push button toward and away from said surface defining means in said interior cavity, the thickness of said annular flange being greater than said predetermined distance between said inner end of said annular wall and said surface defining means in said interior cavity of said housing such that said annular flange is compressed between said inner end of said annular wall and said stationary surface defining means sufficiently to define a hermetic seal therebetween;

(e) said inner end of said annular wall having an edge surface extending between said interior and exterior surfaces thereof and being spaced said predetermined distance above said surface defining means;

(f) said annular flange extending between said edge surface of said inner end of said annular wall and said surface defining means from an inner peripheral portion of said annular flange disposed adjacent to said interior surface of said annular wall to an outer peripheral portion of said annular flange disposed slightly beyond said exterior surface of said annular wall; and (g) an upstanding peripheral rim attached on said outer peripheral portion of said annular flange and projecting upwardly therefrom and surrounding said exterior surface of said annular wall, said peripheral rim terminating closer to said inner end than to said outer end thereof so as to define a socket extending about said inner end and spaced below said outer end facilitating proper alignment of said body portion of said push button within said passageway defined by said annular wall.

6. The assembly as recited in claim 5, wherein said annular web extends at an upwardly and inwardly inclined angle relative to said annular flange.

* * * * *